US011448995B2

(12) United States Patent
Lee et al.

(10) Patent No.: US 11,448,995 B2
(45) Date of Patent: Sep. 20, 2022

(54) CLEAR TONER BASED PHOTO-FINISHING APPARATUS TO REALIZE UNIFORM GLOSSINESS OF PRINTED IMAGE

(71) Applicant: Hewlett-Packard Development Company, L.P., Spring, TX (US)

(72) Inventors: Sun Hyung Lee, Seongnam-si (KR); Seung Jun Lee, Seongnam-si (KR); Choong Kyu Park, Seongnam-si (KR); Giljae You, Seongnam-si (KR); Juhee Kwon, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/283,630

(22) PCT Filed: Feb. 4, 2020

(86) PCT No.: PCT/US2020/016538

§ 371 (c)(1),
(2) Date: Apr. 8, 2021

(87) PCT Pub. No.: WO2020/214228

PCT Pub. Date: Oct. 22, 2020

(65) Prior Publication Data

US 2021/0349416 A1 Nov. 11, 2021

(30) Foreign Application Priority Data

Apr. 19, 2019 (KR) ..... 10-2019-0046354

(51) Int. Cl.
*G03G 15/20* (2006.01)
*G03G 15/00* (2006.01)

(52) U.S. Cl.
CPC ..... *G03G 15/6585* (2013.01)

(58) Field of Classification Search
CPC ..... G03G 15/6585; G03G 8/00
See application file for complete search history.

(56) References Cited

U.S. PATENT DOCUMENTS

| | | | | |
|---|---|---|---|---|
| 6,615,018 | B2 | 9/2003 | Funato | |
| 8,372,571 | B2 * | 2/2013 | Yamanouchi | G03G 15/6585 430/123.41 |
| 8,494,385 | B2 | 7/2013 | Terao et al. | |
| 9,152,104 | B2 | 10/2015 | Kasai et al. | |
| 2005/0025540 | A1 | 2/2005 | Murai et al. | |
| 2005/0214669 | A1 | 9/2005 | Hayashi et al. | |
| 2008/0152406 | A1 | 6/2008 | Choe et al. | |
| 2011/0076074 | A1 | 3/2011 | Yamanouchi et al. | |
| 2012/0051812 | A1 | 3/2012 | Yamano et al. | |

FOREIGN PATENT DOCUMENTS

JP 2011-197319 A 10/2011

* cited by examiner

*Primary Examiner* — Hoang X Ngo
(74) *Attorney, Agent, or Firm* — Jefferson IP Law, LLP

(57) ABSTRACT

An example image forming apparatus includes an image forming unit to form a toner image on a print medium by using an electrophotographic method, a fixing unit to fix the toner image to the print medium by heat and pressure, a photo finishing unit to apply heat and pressure to the print medium after fixing and to cool the print medium, and a clear toner application unit located on an upstream side of the photo finishing unit with respect to a transporting direction of the print medium to apply 0.3 mg/cm$^2$ or more of a clear toner to the print medium.

15 Claims, 7 Drawing Sheets

CLEAR TONER BASED PHOTO-FINISHING APPARATUS TO REALIZE UNIFORM GLOSSINESS OF PRINTED IMAGE

BACKGROUND

An electrophotographic image forming apparatus forms an electrostatic latent image by scanning light on a photoconductor charged at a uniform potential and supplies a toner to the electrostatic latent image to form a toner image on the photoconductor. The toner image passes through an intermediate transfer belt or is directly transferred onto a print medium. The toner image transferred onto the print medium is attached to the print medium by an electrostatic force. A fixing unit applies heat and pressure to the toner image to fix the toner image as a permanent image on the print medium.

A photo finishing apparatus improves glossiness of the printed image by heating and pressing the print medium passed through the fixing unit and by cooling the print medium. The glossiness of the printed image may depend on a type of print medium, the density of the image, and the like.

DETAILED DESCRIPTION OF EXAMPLES

Various examples will be described below with reference to the attached drawings. The examples below may be embodied in many different forms.

Figure 1:
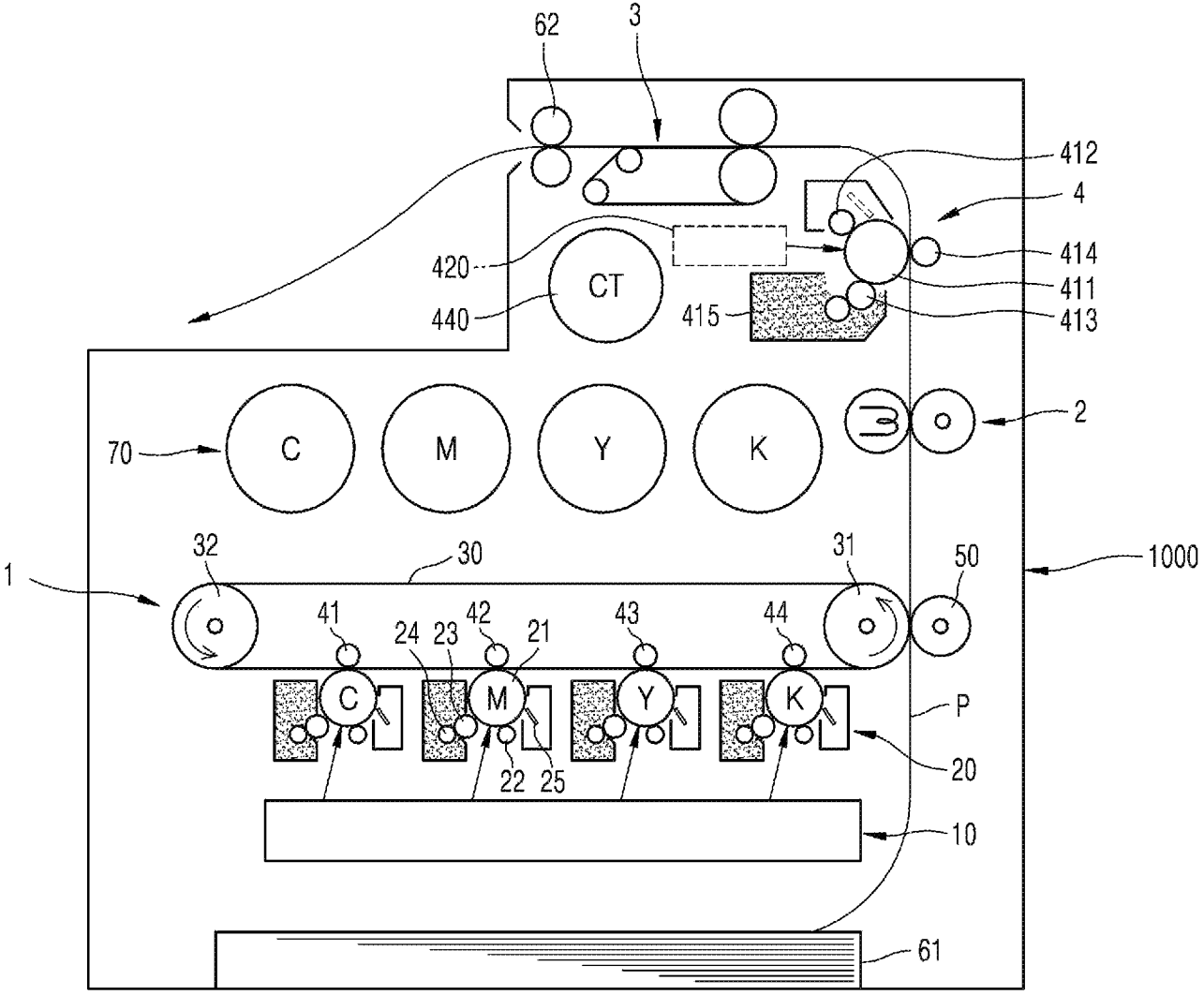
FIG. 1 is a schematic diagram of an image forming apparatus according to an example.

FIG. 1 is a schematic diagram of an image forming apparatus according to an example.

Referring to FIG. 1, an image forming apparatus may include an image forming unit 1 for forming a toner image (e.g., a color toner image) on a print medium P by using an electrophotographic method, a fixing unit 2 for fixing the toner image onto the print medium P by heat and pressure, a photo finishing unit 3 for applying heat and pressure to the print medium P after the fixation by the fixing unit 2 and for cooling the print medium P, and a clear toner application unit 4, located on an upstream side of the photo finishing unit 3 with reference to a transport direction of the print medium P, to apply a clear toner (CT) to the print medium P. In various examples, the clear toner application unit 4 may apply 0.3 mg/cm$^2$ or more of the clear toner to an image plane of the print medium P and may apply the clear toner to an entire image plane of the print medium P. The image forming apparatus may include a print medium transport unit for loading and transporting the print medium P on which an image is to be formed.

In an example, the image forming unit 1 may form a color toner image on the print medium P by using the electrophotographic method. As an example, the image forming unit 1 may include an exposure device 10, a developing device 20, and a transfer device.

For color printing, the developing device 20 may include, for example, four developing devices 20C, 20M, 20Y, and 20K for respectively developing colors of cyan (C), magenta (M), yellow (Y), and black (K). Developers, for example, toners, of the colors of cyan, magenta, yellow, and black may be contained in the four developing devices 20C, 20M, 20Y, and 20K, respectively. The toners of the colors of cyan, magenta, yellow, and black may be contained in four toner supply containers 70C, 70M, 70Y, and 70K, respectively, and may be supplied to the four developing devices 20C, 20M, 20Y, and 20K from the four toner supply containers 70C, 70M, 70Y, and 70K, respectively. The image forming apparatus may further include a developing device to contain toners of various colors such as light magenta, white, etc. in addition to the above-described colors. A toner supply container 70 may be replaced when the contained toner is consumed. The developing device 20 may be attached to and detached from the image forming apparatus via a door (not shown).

Hereinafter, an example image forming unit 1 including the four developing devices 20C, 20M, 20Y, and 20K will be described. Unless otherwise specified, references of C, M, Y, and K will respectively denote components for developing the image of colors of cyan, magenta, yellow, and black, respectively.

The developing device 20 may include a photosensitive drum 21. The photosensitive drum 21 may be independent from the developing device 20. The photosensitive drum 21, which is an example of a photoconductor on a surface of which may be formed an electrostatic latent image, may include a conductive metal pipe and a photosensitive layer formed on a circumference thereof. A charging roller 22 is an example of a charger that charges the photosensitive drum 21 to have a uniform surface electric potential. A charging bias voltage may be applied to the charging roller 22. Instead of the charging roller 22, a charging brush, a corona charger, or the like may be employed. The developing device 20 may further include a cleaning roller (not shown) for removing a foreign substance from a surface of the charging roller 22. A cleaning blade 25 is an example of a cleaning member for removing toner or a foreign substance remaining on the surface of the photosensitive drum 21 after a transfer process, an example of which will be described later. A different type of cleaning member such as a rotating brush may be employed instead of the cleaning blade 25.

The developing device 20 supplies toner to the electrostatic latent image formed on the photosensitive drum 21 to develop the electrostatic latent image into a visible toner image. Developing methods include a one-component developing method using toner, and a two-component developing method using toner and a carrier. In the following example, the developing device 20 will be described as employing the one-component developing method. However, this is merely for conciseness of description and not to be construed as limiting. A developing roller 23 supplies the toner to the photosensitive drum 21. A developing bias voltage for supplying the toner to the photosensitive drum 21 may be applied to the developing roller 23. In an example, a contact developing method in which the developing roller 23 and the photosensitive drum 21 contact each other to form a developing nip is used. A supply roller 24 supplies the toner in the developing device 20 to a surface of the developing roller 23. To this end, a supply bias voltage may be applied to the supply roller 24. The developing device 20 may further include a regulating member (not shown) to regulate an amount of toner which is attached to the surface of the developing roller 23 and supplied to the developing nip where the photosensitive drum 21 and the developing roller 23 are in contact with each other. The regulating member may be, for example, a blade that elastically contacts the surface of the developing roller 23.

The exposure device 10 irradiates a modulated light onto the photosensitive drum 21 in correspondence with image information to form the electrostatic latent image on the photosensitive drum 21. As the exposure device 10, a laser scanning unit (LSU) that uses a laser diode as a light source, a light emitting diode (LED) exposure device that uses an LED as a light source, etc. may be employed.

The transfer device may include an intermediate transfer belt 30, intermediate transfer rollers 41, 42, 43 and 44, and a transfer roller 50. The toner image developed on the photosensitive drum 21 of each of the developing devices 20C, 20M, 20Y, and 20K is temporarily transferred to the intermediate transfer belt 30. The intermediate transfer belt 30 is supported by support rollers 31 and 32 and may circulate by means of the support rollers 31 and 32. The four intermediate transfer rollers 41, 42, 43, and 44 are disposed at positions opposing the photosensitive drum 21 of each of the developing devices 20C, 20M, 20Y, and 20K with the intermediate transfer belt 30 therebetween. An intermediate transfer bias voltage for intermediate transferring of the toner image developed on the photosensitive drum 21 may be applied to the four intermediate transfer rollers 41, 42, 43, and 44. Instead of the intermediate transfer rollers 41, 42, 43, and 44, a corona transfer unit or a pin scorotron transfer unit may be employed. The transfer roller 50 may be positioned to oppose the intermediate transfer belt 30. A transfer bias voltage for transferring the toner image intermediate-transferred to the intermediate transfer belt 30 onto the print medium P may be applied to the transfer roller 50.

When a print command is received from a host (not shown) or the like, a control unit (not shown) may charge the surface of the photosensitive drum 21 to a uniform electric potential using the charging roller 22. The exposure device 10 scans the photosensitive drum 21 of each of the developing devices 20C, 20M, 20Y, and 20K respectively with four light beams modulated corresponding to the image information of each color to form the electrostatic latent image on the photosensitive drum 21. The developing roller 23 of each of the developing devices 20C, 20M, 20Y, and 20K supplies the toners of colors of C, M, Y, and K respectively to the corresponding photosensitive drums 21 to develop the electrostatic latent image into a visible toner image. The developed toner images are overlapped and transferred on the intermediate transfer belt 30. The print medium P loaded on a paper feed tray 61 is transported to the transfer nip formed by the transfer roller 50 and the intermediate transfer belt 30. The toner images overlapped and transferred onto the intermediate transfer belt 30 by the transfer bias voltage applied to the transfer roller 50 are transferred to the print medium P.

The fixing unit 2 fixes the toner image on the print medium P by applying heat and pressure to the print medium P onto which the toner image is transferred. The fixing unit 2 may be implemented in various forms. For example, the fixing unit 2 may include a heating member and a pressing member. The heating member and the pressing member may be elastically pressed against each other to form a fixing nip. The heating member may be implemented in the form of, for example, a heat roller, a fixing belt, or the like. The heating member is heated by a heat source. As the heat source, for example, a halogen lamp may be employed. The heating member is in contact with the image plane of the print medium P. The image plane is a surface of the print medium P onto which the toner image is transferred. When the print medium P onto which the toner image is transferred passes through the fixing nip, the toner image is fixed to the print medium P by heat and pressure.

The photo finishing unit 3 heats and presses the print medium P that passed through the fixing unit 2 and then cools the print medium P to improve glossiness of a printed image. The print medium P that passed through the photo finishing unit 3 is discharged from a main body 1000 by a discharge roller 62.

Figure 2:
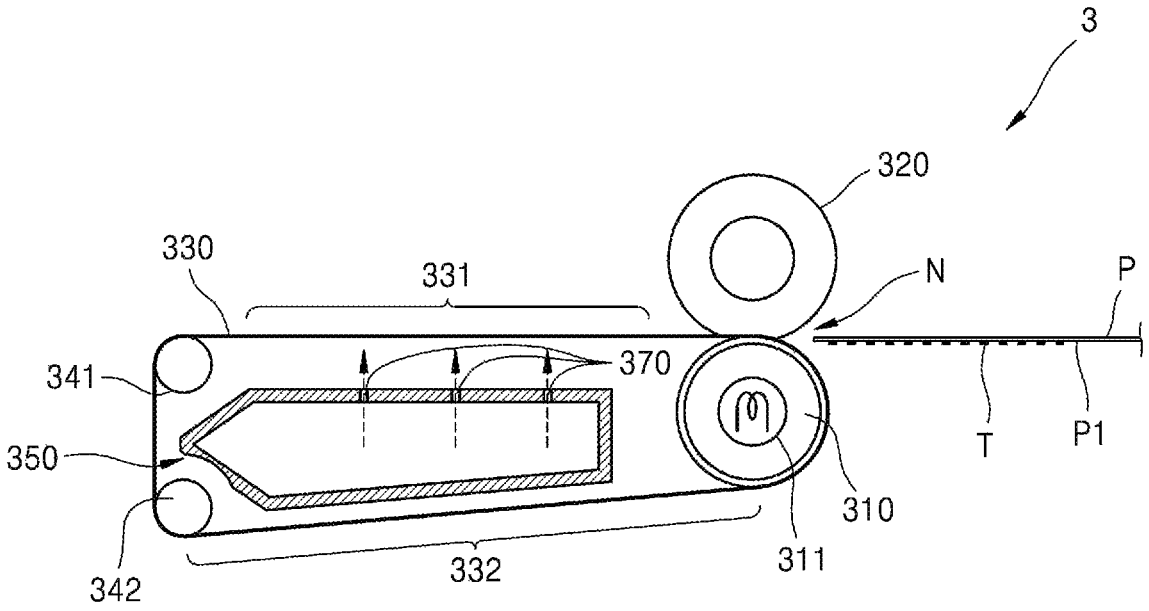
FIG. 2 is a schematic diagram of a photo finishing unit according to an example.

FIG. 2 is a schematic diagram of a photo finishing unit according to an example.

Referring to FIG. 2, the photo finishing unit 3 may include a heating roller 310, a pressing roller 320, a belt 330, and a cooling device. As an example of the cooling device, a blower (not shown) providing cooling air and a hollow duct 350 are employed. An air discharge port 370 open toward the belt 330 is provided in the hollow duct 350. The blower may be located inside the hollow duct 350 or may be located outside the hollow duct 350 to supply the cooling air through one end of the hollow duct 350.

The heating roller 310 may have a structure in which a release layer is formed on an outer surface of a metal core such as aluminum (Al) or stainless steel. A heat resistant elastic layer may be provided between the metal core and the release layer. The heating roller 310 opposes an image plane P1 of the print medium P and applies heat to the toner image fixed on the image plane P1. To this end, the heating roller 310 is heated by a heat source 311. As the heat source 311, a halogen lamp, a heating resistance coil, an induction heater, a ceramic heater, etc. may be employed. In an example, a halogen lamp is employed as the heat source 311. The halogen lamp may be installed inside the metal core at a position substantially equal to a rotation axis of the heating roller 310.

The pressing roller 320 is pressed against the heating roller 310 to form a heating nip N through which the print medium P passes. The pressing roller 320 may be a structure in which a heat resistant elastic layer and a release layer using a heat resistant resin coating or a heat resistant rubber coating are formed on the outer surface of a metal core. The pressing roller 320 forms the heating nip N with the heating roller 310 with the belt 330 therebetween. The pressing roller 320 presses the print medium P passing through the heating nip N to have the image plane P1 on which a toner image T is formed to be closely adhered to the belt 330.

The belt 330 is supported by the heating roller 310 so as to pass through the heating nip N and extends to a downstream side of the heating nip N to support the print medium P. The belt 330 may have a thickness that is flexible enough to circulate and travel by rotation of the heating roller 310 and support rollers 341 and 342 that will be described later. An outer surface of the belt 330 may be a smooth surface. The belt 330 may include a substrate and a release layer. The substrate may include a thin film of a heat resistant resin such as polyimide (PI), polyamide (PA), or polyamideimide (PAI), or a metal thin film such as stainless steel, nickel (Ni), etc. A thickness of the substrate may be about 30 μm to about 200 μm. For example, the thickness of a polyimide substrate may be about 50 μm to about 100 μm. The release layer may be formed on a surface of the substrate. The release layer may include a perfluoroalkoxy (PFA) resin, a polytetrafluoroethylene (PTFE), a fluorinated ethylene propylene (FEP), another type of fluorine resin, or the like. A thickness of the release layer may be about 10 μm to about 30 μm. An elastic layer may be further provided between the substrate and the release layer. The elastic layer may include various rubber materials such as fluorine rubber, silicone rubber, natural rubber, isoprene rubber, butadiene rubber, nitrile rubber, chloroprene rubber, butyl rubber, acrylic rubber, hydrin rubber, urethane rubber, or the like, elastic materials including various thermoplastic elastomers such as styrene, polyolefin, polyvinyl chloride, polyurethane, polyester, polyamide, polybutadiene, chlorinated polyethylene, etc. or combinations of two or more thereof. A thickness of the elastic layer may be about 100 μm to about 300 μm considering the heat transfer efficiency to the print medium P.

The photo finishing unit 3 may include the one or more support rollers 341 and 342 for supporting the belt 330 together with the heating roller 310. The belt 330 may be supported by the heating roller 310 and the support rollers 341 and 342 and circulate by means of the heating roller 310 and the support rollers 341 and 342. The print medium P is supported by the belt 330 after passing through the heating nip N. The photo finishing unit 3 may include a first period 331 in which the belt 330 extends toward a downstream side of the heating nip N in a moving direction of the print medium P and a second period 332 in which the belt 330 extends from the first period 331 toward an upstream side of the heating nip N. The first period 331 may be a period between the heating roller 310 and the support roller 341. The second period 332 may be a period between the support roller 342 and the heating roller 310.

The duct 350 may be located inside or outside of the belt 330. In the illustrated example, the duct 350 is located inside the belt 330. The duct 350 may be spaced apart from the first period 331, for example spaced below the belt 330. The blower (not shown) supplies air into the duct 350. The blower may be an axial fan, a centrifugal blower, or the like capable of providing a relatively high and stable static pressure. The air discharge port 370 opposes the first period 331 such that the air supplied by the blower may effectively cool the image plane P1 of the print medium P. The air discharge port 370 opposes an inner surface of the belt 330. An example of the air discharge port 370 may vary such as by including a slit extending in a width direction, a plurality of holes arranged in the width direction, a structure in which each of the slit and the plurality of the holes or a combination thereof is arranged in a traveling direction of the print medium P, etc.

The image plane P1 of the print medium P opposes an outer surface of the belt 330 when passing through the heating nip N. The print medium P is pressed against the outer surface of the belt 330 by a pressing force provided by the pressing roller 320. The toner image T on the image plane P1 of the print medium P is heated and melted by thermal energy provided by the heating roller 310 while passing through the heating nip N. For example, the toner image T may be heated to a glass transition temperature or higher. The outer surface of the belt 330 is a smooth surface with a very low surface roughness, the toner image T is subjected to thermal energy and pressure in the heating nip N and pressed onto the outer surface of the belt 330 as described above, and the surface roughness of the image plane P1 is lowered. When the surface roughness of the image plane P1 is lowered, a proportion of diffuse reflection light among light reflected from the image plane P1 is reduced and a proportion of specular reflection light is increased. Thus, glossiness of a printed image may be increased.

A rapid cooling of the print medium P is effective in improving the glossiness. The air supplied into the duct 350 by the blower is discharged toward the first period 331 of the photo finishing unit 3 through the air discharge port 370. The print medium P is rapidly cooled by the discharged air and adhesion between the toner image T and the outer surface of the belt 330 may be weakened. When the print medium P reaches an end of the first period 331, for example when the print medium P reaches the support roller 341, the print medium P may be separated from the belt 330 by rigidity of the print medium P.

Figure 3:
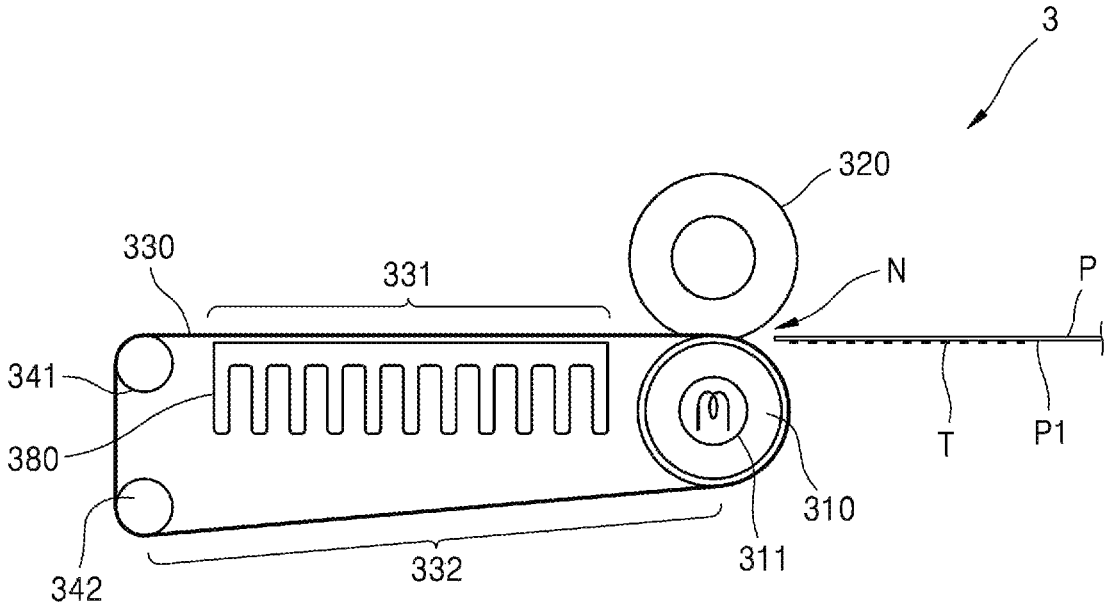
FIG. 3 is a schematic diagram of a photo finishing unit according to an example.

FIG. 3 is a schematic diagram of a photo finishing unit according to an example.

Referring to FIG. 3, the photo finishing unit 3 differs from the photo finishing unit shown in FIG. 2 in that a heat sink 380 is used. The heat sink 380 may contact an inner surface of the belt 330 to cool the print medium P. Although not shown in the drawings, one end or both ends of the heat sink 380 may be cooled by air supplied by a blower. In addition, the heat sink 380 may be accommodated in a duct, and air supplied into the duct by the blower may cool the heat sink 380.

As described above, when the print medium P, on which the toner image T is formed, is heated and pressed on the belt 330 and then cooled, glossiness of a printed image increases. Thus, a similar effect as a photographic image may be obtained.

Figure 4:
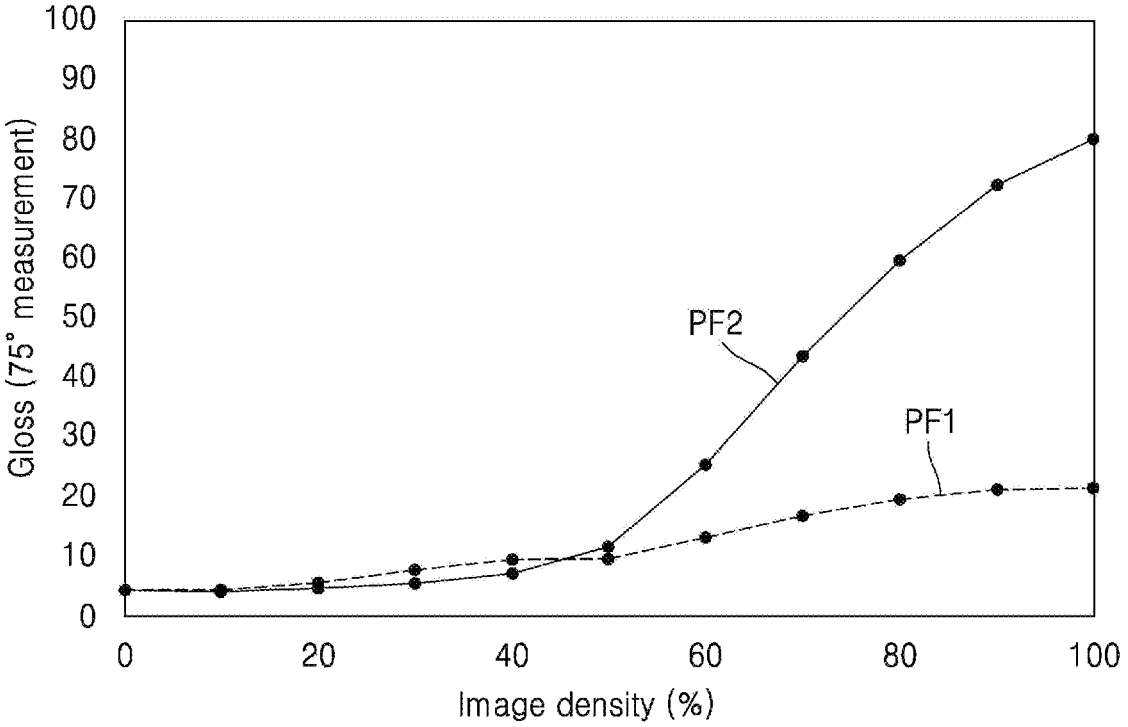
FIG. 4 is a graph showing a change in glossiness of a printed image before and after a photo finishing processing according to an example.

FIG. 4 is a graph showing a change in glossiness of a printed image before and after a photo finishing processing according to an example.

Referring to FIG. 4, PF1 denotes the glossiness of the printed image before photo finishing processing, and PF2 denotes the glossiness of the printed image after photo finishing processing. As illustrated in FIG. 4, the glossiness of the printed image increases after photo finishing processing. In the example of FIG. 4, the glossiness of the printed image was measured with a glossiness measuring device (Model Name: GlossMaster/GlossMate 75°) manufactured by Quality Image products.

When paper with high glossiness such as a photo paper is used as the print medium P, a difference in the glossiness between a part where the printed image is formed and a part where the printed image is not formed is small. When a plain paper with low glossiness is used as the print medium P, a glossiness non-uniformity may occur depending on the density of the printed image. For example, a surface of the print medium P is not exposed in a high image density part of the printed image because a large amount of toner is transferred to the high image density part. The surface of the print medium P may be partially exposed in a low image density part of the printed image because a small amount of toner is transferred to the low image density part. When photo finishing processing is performed on such a printed image, the glossiness of the low image density part is lower than that of the high image density part, which results in a non-uniformity of glossiness of the printed image. As shown in the example of FIG. 4, the higher the image density, the higher the glossiness of the printed image after photo finishing processing. In other words, the glossiness of the printed image greatly increases in the high image density part after photo finishing processing. However, the glossiness of the printed image hardly increases in the lower image density part even after photo finishing processing. Therefore, after photo finishing processing, a high gloss part and a low gloss part may mix to cause the glossiness non-uniformity.

Referring again to FIG. 1, the image forming apparatus may apply clear toner (e.g., a transparent toner) to the print medium P using the clear toner application unit 4 before photo finishing. The clear toner application unit 4 may be positioned between the fixing unit 2 and the photo finishing unit 3.

The clear toner application unit 4 may apply the clear toner onto the entire image plane P1 of the print medium P, a part of the image plane P1 of the print medium P where a toner image is not formed, or the part of the image plane P1 of the print medium P where the toner image is not formed and a part where the toner image has a low density. In an example, the clear toner application unit 4 applies the clear toner to the entire image plane P1 of the print medium P. In this case, a non-exposure type electrophotographic method may be employed in the clear toner application unit 4.

The clear toner application unit 4 may include a containing unit 415 in which the clear toner is contained, a charge receiving member 411, a charge supplying member 412 for supplying a charge of an opposite polarity to a charge polarity of the clear toner to the charge receiving member 411, a developing member 413 for receiving an application of a developing bias voltage for supplying (e.g., transferring) the clear toner to the charge receiving member 411 and for attaching the clear toner contained in the containing unit 415 to the charge receiving member 411, and a transfer member 414, to which a transfer bias voltage of the opposite polarity to the charge polarity of the clear toner is applied, opposing the charge receiving member 411 with the print medium P therebetween, for transferring the clear toner attached to the charge containing member 411 to the print medium P. The clear toner may be supplied from a clear toner container 440 to the containing unit 415.

According to an example described above, the clear toner may be applied to the entire image plane P1 of the print medium P with a simple structure. A surface of the print medium P is not exposed on the image plane P1 when the clear toner is applied, and thus it is possible to improve the glossiness and glossiness uniformity after photo finishing processing.

The uniformity of glossiness may depend on the image density and an amount of the clear toner applied to the image plane P1 of the print medium P. Because it is difficult to obtain the uniformity of glossiness, it is necessary to determine an appropriate application amount of the clear toner.

Figure 5:
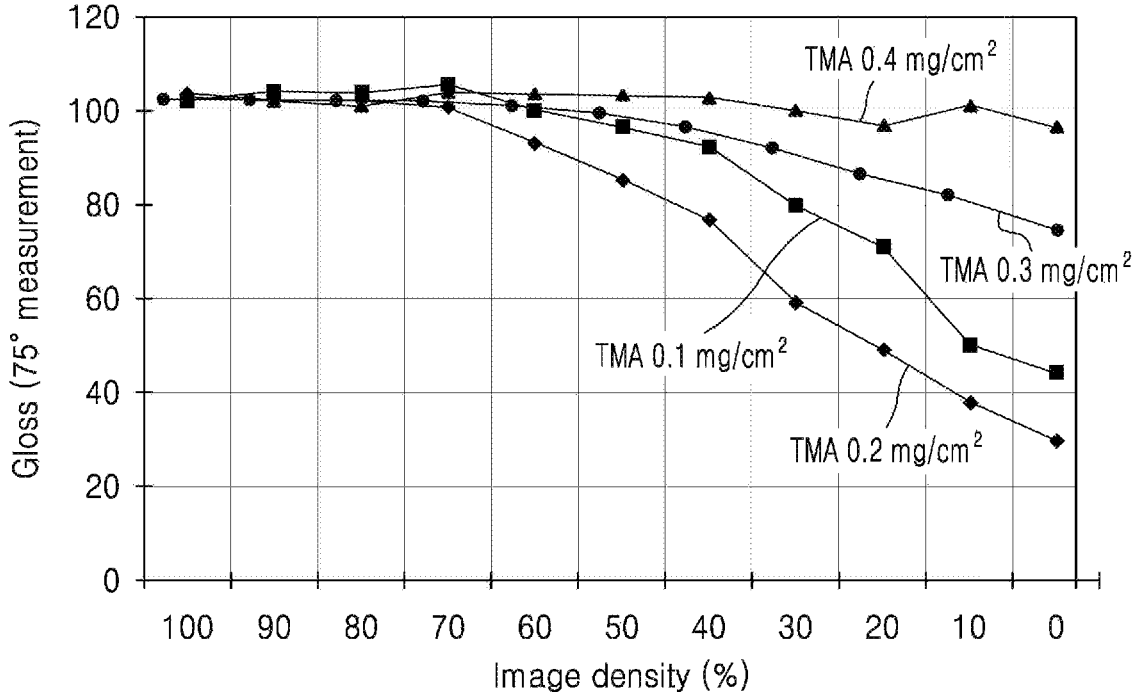
FIG. 5 is a graph showing a result of measuring a change in glossiness according to an image density while changing a clear toner mass per unit area (TMA) according to an example.

FIG. 5 is a graph showing a result of measuring a change in glossiness according to an image density while changing a clear toner mass per unit area according to an example.

Referring to FIG. 5, glossiness according to an image density was measured at a clear toner mass per unit area (TMA) of 0.1 mg/cm$^2$, 0.2 mg/cm$^2$, 0.3 mg/cm$^2$, and 0.4 mg/cm$^2$. In an example, a photo finishing processing speed is 10 mm/sec, and a heating temperature of the photo finishing unit 3 is 170° C. As illustrated in FIG. 5, it may be seen that when the clear toner is applied with a TMA of 0.1~0.2 mg/cm$^2$ to the entire image plane P1 of the print medium P, even after photo finishing processing, glossiness of a lower image density part (i.e., a part where less toner is transferred) is lower than that of a high image density part such that the glossiness uniformity is low when considering the entire printed image. On the other hand, it may be seen that when the clear toner is applied with a TMA of 0.3~0.4 mg/cm$^2$ to the entire image plane P1 of the print medium P, when photo finishing processing is performed, the part where the image density is low also shows a high glossiness of 70 or more. For example, it may be seen that when the clear toner is applied with a TMA of 0.4 mg/cm$^2$, glossiness of a part where the image density is low and a part with no image are substantially the same as that of a part where the image density is high. As described above, when photo finishing processing is performed after the clear toner is applied to the entire image plane P1, the glossiness of the part where the image density is low and the part with no image may be improved, which reduces a glossiness deviation in the entire printed image. Thus, the glossiness uniformity may be improved.

In an example, considering the visibility and quality of the image, the glossiness deviation may be controlled to within 30%. Referring to the graph shown in FIG. 5, when the clear toner is applied with a TMA of 0.3 mg/cm$^2$ or more, the glossiness deviation in the entire printed image may be less than 30%.

Figure 6:
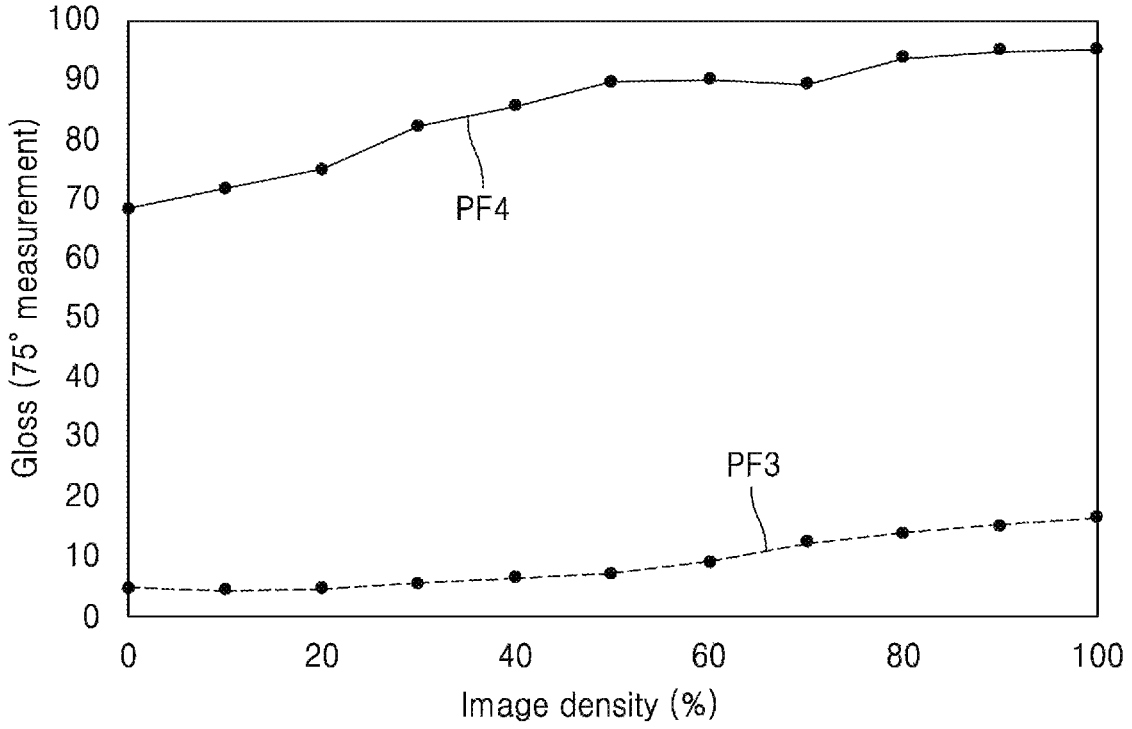
FIG. 6 is a graph showing a result of measuring glossiness according to an image density when a clear toner is applied with a TMA of 0.3 mg/cm$^2$ according to an example.

FIG. 6 is a graph showing a result of measuring glossiness according to an image density when a clear toner is applied with a TMA of 0.3 mg/cm$^2$ according to an example.

Referring to FIG. 6, a photo finishing processing speed is 30 mm/sec, and a heating temperature of the photo finishing unit 3 is 170° C. In the example of FIG. 6, it may be seen that the glossiness after photo finishing processing PF4 is improved as compared with the glossiness before photo finishing processing PF3. In addition, it may be seen that a glossiness deviation in a part where the image density is high and a part where the image density is low is within 30%. Thus, glossiness uniformity is improved.

By applying the clear toner with a TMA of 0.3 mg/cm$^2$ or more, glossiness and glossiness uniformity of a printed image may be improved. In addition, a printed image such as a photograph may be obtained using a relatively low-cost plain paper as compared with a photo paper.

In an example, a clear toner mass may be adjusted based on a magnitude of a developing bias voltage applied to the developing member 413. As an example, the clear toner mass may be detected by forming a patch for mass measurement on the print medium P using the clear toner application unit 4 and detecting the patch using a sensor. The sensor may be, for example, an optical sensor. An amount of light reflected by the optical sensor depends on the clear toner mass, and thus, the clear toner mass may be detected from the amount of reflected light. The magnitude of the developing bias voltage may be adjusted such that a TMA is 0.3 mg/cm$^2$ or more with respect to the detected mass.

In an example, the clear toner application unit 4 may apply the clear toner to the image plane P1 of the print medium P by using an electrophotographic method. A structure of the clear toner application unit 4 may be similar to a structure of the image forming unit 1 that forms a toner image on the print medium P by using the electrophotographic method. For example, in FIG. 1, the charge receiving member 411, the charge supplying member 412, the developing member 413, and the transfer member 414 may be respectively a photosensitive drum, a charging roller, a developing roller, and a transfer roller, and, as shown by a dashed line, an exposure device 420 that forms an electrostatic latent image may further be employed. A charging bias voltage may be applied to a charging roller to charge a surface of a photosensitive drum to a uniform electric potential and an electrostatic latent image corresponding to a clear toner image may be formed by irradiating light onto the charged surface of the photosensitive drum using the exposure device 420. A developing bias voltage may be applied to a developing roller opposing the photosensitive drum to supply the clear toner to the electrostatic latent image to form a clear toner image on the surface of the photosensitive drum, and a transfer bias voltage may be applied to a transfer roller opposed to the photosensitive drum and forming a transfer nip to transfer the clear toner image to the image plane P1 of the print medium P.

Figure 7:
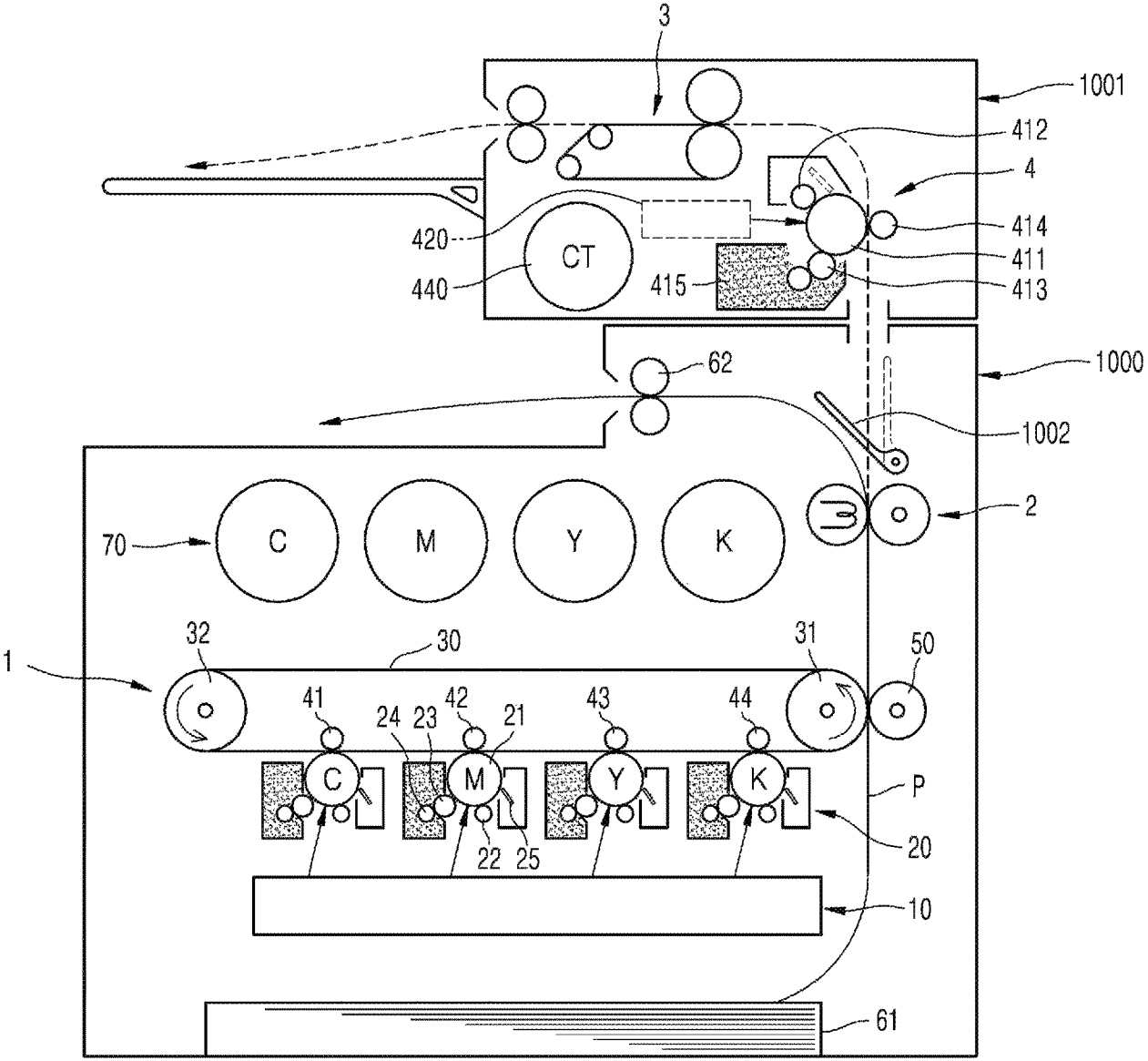
FIG. 7 is a schematic diagram of an image forming apparatus according to an example.

FIG. 7 is a schematic diagram of an image forming apparatus according to an example.

Referring to FIG. 7, the image forming apparatus includes a main body 1000 including the image forming unit 1 and the fixing unit 2, and a post-processing unit 1001 including the photo finishing unit 3 and the clear toner application unit 4. The post-processing unit 1001 is attachable/detachable to/from the main body 1000.

When the post-processing unit 1001 is not provided, the print medium P that passed through the fixing unit 2 is discharged from the main body 1000 by the discharge roller 62. When the post-processing unit 1001 is mounted on the main body 1000, the print medium P that passed through the fixing unit 2 is supplied to the post-processing unit 1001, and, after application of clear toner and photo finishing processing, is discharged from the post-processing unit 1001.

The image forming apparatus may further include a path selecting member 1002 located at an exit of the fixing unit 2 to selectively guide the print medium P to the post-processing unit 1001. The path selecting member 1002 may be switched between a first position (i.e., a position shown in a solid line) that directly discharges the print medium P that passed through the fixing unit 2 from the main body 1000 without performing gloss processing on the print medium P, and a second position (i.e., a position shown in a dashed line) that guides the print medium P that passed through the fixing unit 2 to the post-processing unit 1001. In an example, the path selecting member 1002 may be switched by a driving means such as a solenoid. According to the example described above, selective gloss processing is possible. In other words, when paper with a high glossiness is used as the print medium P, the path selecting member 1002 may be positioned at the first position to directly discharge the print medium P that passed through the fixing unit 2 from the main body 1000 without performing gloss processing on the print medium P. When a plain paper with a low glossiness is used as the print medium P, the path selecting member 1002 may be positioned at the second position as necessary to guide the print medium P that passed through the fixing unit 2 to the post-processing unit 1001.

Figure 8:
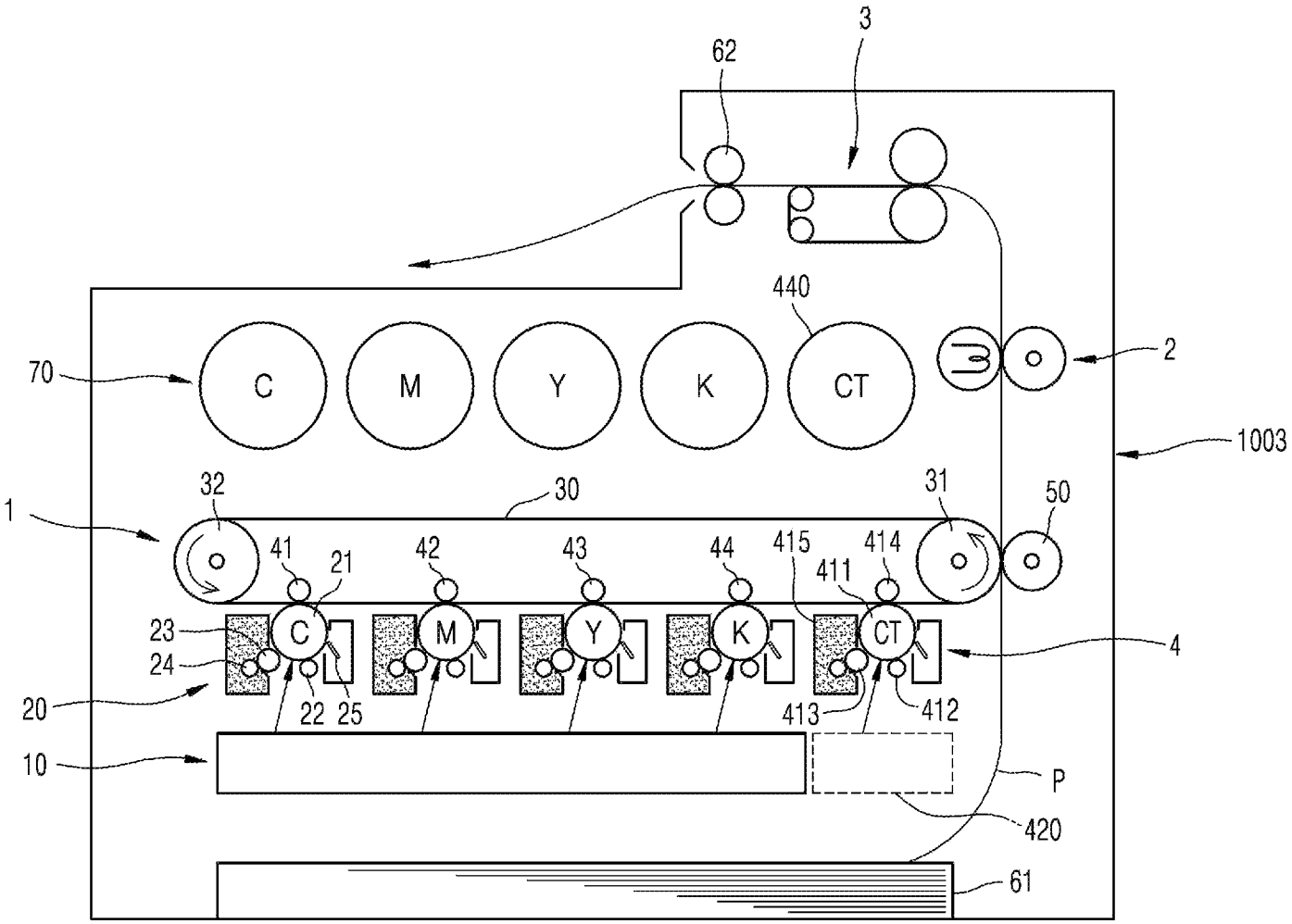
FIG. 8 is a schematic diagram of an image forming apparatus according to an example.

FIG. 8 is a schematic diagram of an image forming apparatus according to an example.

Referring to FIG. 8, the image forming unit 1, the fixing unit 2, the photo finishing unit 3, and the clear toner application unit 4 are the same as those described with reference to FIGS. 1 to 7. Therefore, a redundant description is omitted and a difference from the image forming apparatus shown in FIGS. 1 and 7 is mainly described.

In the example of FIG. 8, the clear toner application unit 4 is located on an upstream side of the fixing unit 2 with reference to a transporting direction of the print medium P.

The clear toner may be transferred to the print medium P via the intermediate transfer belt 30. For example, the image forming unit 1 may include the developing device 20 for forming a toner image (e.g., a color toner image) on the photosensitive drum 21, the intermediate transfer belt 30 for temporarily containing the toner image, and the transfer roller 50, opposing the intermediate transfer belt 30 with the print medium P therebetween to form a transfer nip, for transferring the toner image to the print medium P.

When the toner image and a clear toner image are transferred to the print medium P, the clear toner image may be an outermost layer or an innermost layer. To this end, in the intermediate transfer belt 30, the clear toner image needs to be the innermost layer or the outermost layer. Therefore, the clear toner application unit 4 may apply the clear toner to the intermediate transfer belt 30 on an upstream side or a downstream side of the developing device 20 based on a traveling direction of the intermediate transfer belt 30.

For example, as shown in FIG. 8, the clear toner application unit 4 may be disposed at a downstream side relative to the developing device 20K disposed at the most downstream side based on the traveling direction of the intermediate transfer belt 30 among the four developing devices 20C, 20M, 20Y, and 20K. In this case, the clear toner on the print medium P becomes the innermost layer.

Conversely, although not shown in the figure, the clear toner application unit 4 may be disposed at an upstream side relative to the developing device 20C disposed at the most upstream side based on the traveling direction of the intermediate transfer belt 30 among the four developing devices 20C, 20M, 20Y, and 20K. In this case, the clear toner on the print medium P becomes the outermost layer.

According to the examples described above, in a state where the toner image (e.g., the color toner image) is formed on the image plane P1 of the print medium P and the clear toner image is formed on the entire image plane P1, the toner image and the clear toner image are primarily fixed on the print medium P by passing through the fixing unit 2. The print medium P that passed through the fixing unit 2 is heated, pressed, and cooled while passing through the photo finishing unit 3. Accordingly, glossiness of the printed image may be improved, and glossiness uniformity may be improved.

The clear toner application unit 4 may apply the clear toner to the intermediate transfer belt 30 by using the electrophotographic method as described above and apply the clear toner to the intermediate transfer belt 30 by using a non-exposure electrophotographic method.

A mass of the clear toner may be adjusted based on a magnitude of a developing bias voltage applied to the developing member 413. A patch for mass measurement may be formed on the intermediate transfer belt 30 using the clear toner application unit 4 and detected using a sensor. Thus, the mass of the clear toner may be detected. The sensor may be, for example, an optical sensor. An amount of light reflected by the optical sensor depends on the clear toner mass, and thus, the clear toner mass may be detected from the amount of reflected light. The magnitude of the developing bias voltage applied to the developing member 413 may be adjusted such that a TMA is 0.3 $mg/cm^2$ or more with respect to the detected mass.

Figure 9:
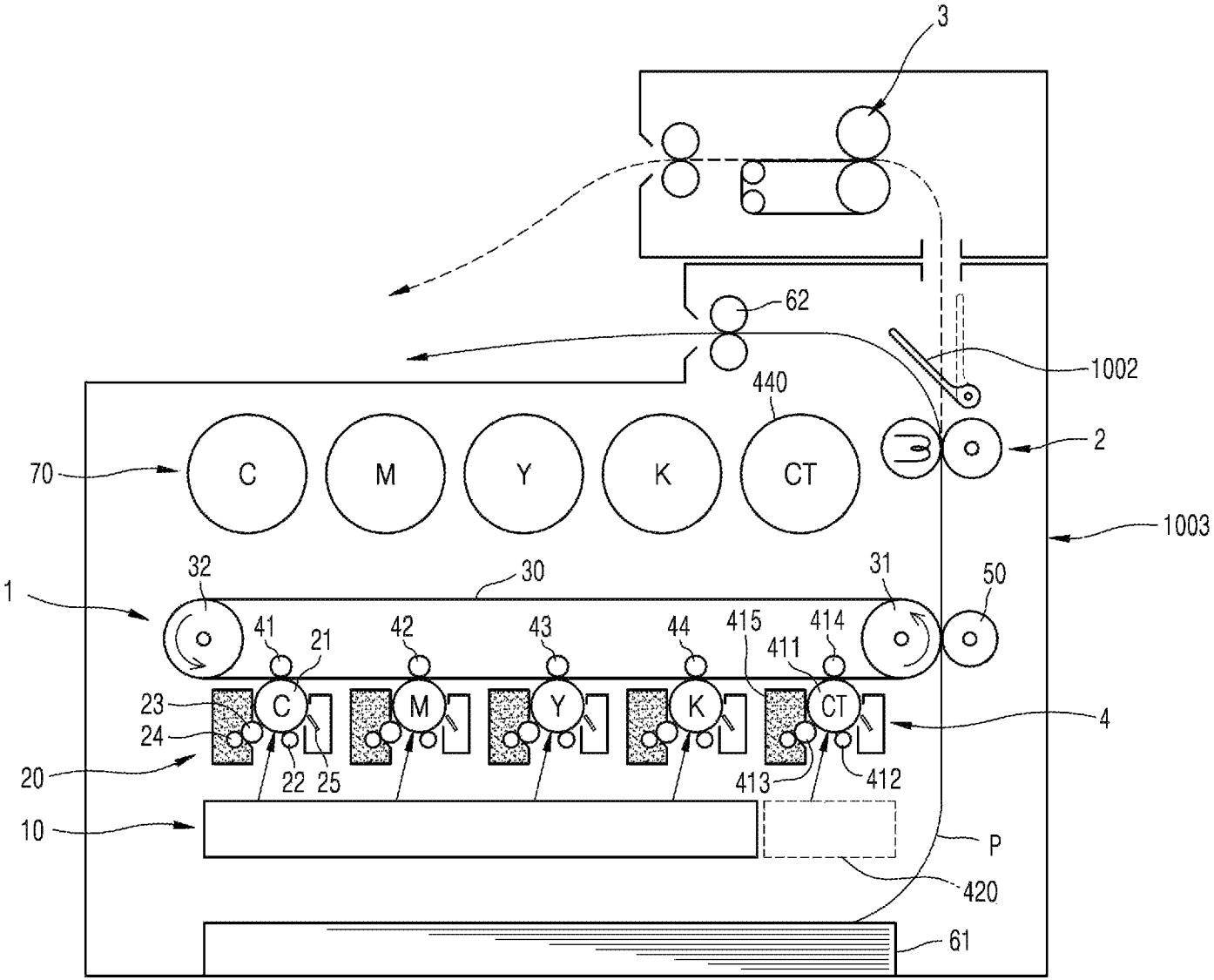
FIG. 9 is a schematic diagram of an image forming apparatus according to an example.

FIG. 9 is a schematic diagram of an image forming apparatus according to an example.

Referring to FIG. 9, a main body 1003 including the image forming unit 1, the clear toner application unit 4, and the fixing unit 2, and the photo finishing unit 3 are shown. The photo finishing unit 3 is attachable/detachable to/from the main body 1003.

When the photo finishing unit 3 is not provided, the print medium P on which a toner image is formed is discharged from the main body 1003 by the discharge roller 62 after passing through the fixing unit 2 without performing gloss processing thereon. At this time, the clear toner application unit 4 may not operate. In an example, the print medium P on which the toner image and a clear toner image are formed may be discharged from the main body 1003 by the discharge roller 62 after passing through the fixing unit 2 by operating the clear toner application unit 4. This may also result in obtaining an effect of improving glossiness.

When the photo finishing unit 3 is mounted on the main body 1003, the clear toner application unit 4 may operate in a printing process. The clear toner application unit 4 may selectively operate based on a kind of the print medium P or a user input. For example, when the print medium P is paper with high glossiness (e.g., a photo paper), the clear toner application unit 4 may not operate. When the print medium P is paper with low glossiness (e.g., a plain paper), the clear toner application unit 4 may selectively operate either automatically or by the user input.

The print medium P on which the toner image and the clear toner image are formed by the image forming unit 1 and the clear toner application unit 4 may be supplied to the photo finishing unit 3 after passing through the fixing unit 2, and may be discharged from the photo finishing unit 3 after photo finishing.

The image forming apparatus may further include the path selecting member 1002 located at an exit of the fixing unit 2 to selectively guide the print medium P to the photo finishing unit 3. The path selecting member 1002 may be switched between a first position (i.e., a position shown in a solid line) that discharges the print medium P that passed through the fixing unit 2 from the main body 1003, and a second position (i.e., a position shown in a dashed line) that guides the print medium P that passed through the fixing unit 2 to the photo finishing unit 3. In an example, the path selecting member 1002 may be switched by a driving means such as a solenoid. According to examples described above, selective gloss processing is possible. In other words, when paper with a high glossiness is used as the print medium P, the path selecting member 1002 may be positioned at the first position to discharge the print medium P that passed through the fixing unit 2 from the main body 1003. When a plain paper with a low glossiness is used as the print medium P, the path selecting member 1002 may be positioned at the second position as necessary to guide the print medium P that passed through the fixing unit 2 to the photo finishing unit 3.

The examples described herein should be considered in a descriptive sense only and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope as defined by the following claims.

What is claimed is:

1. An image forming apparatus comprising:

an image forming unit to form a toner image on a print medium by using an electrophotographic method;

a fixing unit to fix the toner image to the print medium by heat and pressure;

a photo finishing unit to apply heat and pressure to the print medium after the fixing and to cool the print medium; and a clear toner application unit located downstream of the fixing unit, with reference to a transport direction of the print medium, and upstream of the photo finishing unit, with reference to the transport direction of the print medium, to apply a clear toner to the print medium.

2. The image forming apparatus of claim 1, wherein the clear toner application unit is to apply the clear toner to an entire image plane of the print medium.

3. The image forming apparatus of claim 1, wherein the clear toner application unit applies 0.3 $mg/cm^2$ or more of the clear toner to the print medium.

4. The image forming apparatus of claim 1, wherein the clear toner application unit is to apply the clear toner to the print medium by using a non-exposure type electrophotographic method.

5. The image forming apparatus of claim 1, wherein the clear toner application unit comprises:

a containing unit to contain the clear toner;

a charge receiving member;

a charge supplying member to supply a charge of a polarity opposite to a charge polarity of the clear toner to the charge receiving member;

a developing member to receive application of a developing bias voltage for supplying the clear toner to the charge receiving member and to attach the clear toner contained in the containing unit to the charge receiving member; and a transfer member to receive application of a transfer bias voltage of a polarity opposite to the charge polarity of the clear toner and to transfer the clear toner attached to the charge receiving member to the print medium, the transfer member opposing the charge receiving member with the print medium therebetween.

6. The image forming apparatus of claim 1, further comprising:

a main body comprising the image forming unit and the fixing unit; and a post-processing unit, attachable/detachable to/from the main body, comprising the photo finishing unit and the clear toner application unit.

7. The image forming apparatus of claim 6, further comprising:

a path selecting member located at an exit of the fixing unit to selectively guide the print medium to the post-processing unit.

8. An image forming apparatus comprising:

an image forming unit to form a color image on a print medium;

a fixing unit to fix the color image to the print medium by heat and pressure;

a photo finishing unit to apply heat and pressure to the print medium applied with a clear toner and to cool the print medium; and a clear toner application unit located downstream of the fixing unit, with reference to a transport direction of the print medium, and upstream of the photo finishing unit, with reference to the transport direction of the print medium, to apply the clear toner to the print medium.

9. The image forming apparatus of claim 8, further comprising a path selection member located at an exit of the fixing unit to selectively guide the print medium to the clear toner application unit.

10. The image forming apparatus of claim 8, further comprising a main body comprising the image forming unit and the fixing unit; and a post-processing unit, attachable/detachable to/from the main body, comprising the photo finishing unit and the clear toner application unit.

11. A post processing apparatus comprising:

a clear toner application unit to apply a clear toner to a print medium; and a photo finishing unit located downstream of the clear toner application unit to apply heat and pressure to the print medium, wherein the post processing apparatus is attachable/detachable to/from a main body of an image forming apparatus.

12. The post processing apparatus of claim 11, wherein the clear toner application unit is to apply the clear toner to an entire image plane of the print medium.

13. The post processing apparatus of claim 11, wherein the clear toner application unit applies 0.3 $mg/cm^2$ or more of a clear toner to the print medium.

14. The post processing apparatus of claim 11, wherein the clear toner application unit is to apply the clear toner to the print medium by using a non-exposure type electrophotographic method.

15. The post processing apparatus of claim 11, wherein the clear toner application unit comprises:

a containing unit to contain the clear toner;

a charge receiving member;

a charge supplying member to supply a charge of a polarity opposite to a charge polarity of the clear toner to the charge receiving member;

a developing member to receive application of a developing bias voltage for supplying the clear toner to the charge receiving member and to attach the clear toner contained in the containing unit to the charge receiving member; and a transfer member to receive application of a transfer bias voltage of a polarity opposite to the charge polarity of the clear toner and to transfer the clear toner attached to the charge receiving member to the print medium, the transfer member opposing the charge receiving member with the print medium therebetween.

* * * * *